US010651002B2

(12) United States Patent
Masaki

(10) Patent No.: US 10,651,002 B2
(45) Date of Patent: May 12, 2020

(54) X-RAY TUBE

(71) Applicant: Shimadzu Corporation, Kyoto (JP)

(72) Inventor: Toshimichi Masaki, Kyoto (JP)

(73) Assignee: Shimadzu Corporation, Nakagyo-ku, Kyoto-shi, Kyoto (JP)

( * ) Notice: Subject to any disclaimer, the term of this patent is extended or adjusted under 35 U.S.C. 154(b) by 0 days.

(21) Appl. No.: 16/335,102

(22) PCT Filed: Mar. 6, 2017

(86) PCT No.: PCT/JP2017/008711
§ 371 (c)(1),
(2) Date: Mar. 20, 2019

(87) PCT Pub. No.: WO2018/055795
PCT Pub. Date: Mar. 29, 2018

(65) Prior Publication Data

US 2019/0237287 A1 Aug. 1, 2019

(30) Foreign Application Priority Data

Sep. 21, 2016 (JP) ..... 2016-184235

(51) Int. Cl.
*H01J 35/14* (2006.01)
*H01J 35/18* (2006.01)
*H01J 35/16* (2006.01)

(52) U.S. Cl.
CPC ..... *H01J 35/147* (2019.05); *H01J 35/14* (2013.01); *H01J 35/16* (2013.01); *H01J 35/18* (2013.01)

(58) Field of Classification Search
CPC ..... H01J 35/147; H01J 35/14; H01J 35/16; H01J 35/18

(Continued)

(56) References Cited

U.S. PATENT DOCUMENTS

2014/0270071 A1* 9/2014 Shirota ..... H01J 35/14 378/62
2017/0053771 A1* 2/2017 Jeong ..... H01J 35/045
2017/0110283 A1* 4/2017 Shirota ..... H01J 35/14

FOREIGN PATENT DOCUMENTS

JP 47-36950 9/1972
JP 53-133387 A 11/1978

(Continued)

OTHER PUBLICATIONS

International Search Report dated Sep. 5, 2017 for PCT application No. PCT/JP2017/008711.

*Primary Examiner* — Courtney D Thomas
(74) *Attorney, Agent, or Firm* — Muir Patent Law, PLLC

(57) ABSTRACT

Provided is an X-ray tube capable of obtaining a clear X-ray image by reducing unnecessary X-rays radiated from a holder shaft. The X-ray tube includes an electron source 12 for generating an electron beam B, an anode 13 for accelerating the electron beam B and having a hole 13*a* allowing the electron beam B to pass through, a cylindrical holder shaft 14 forming a passage for allowing the electron beam B to pass through a hole 13*a* of the anode 13, a magnetic lens 17 arranged around the holder shaft 14 and configured to converge the electron beam B, a target holder 15 connected to the holder shaft 14, a target 16 arranged in the target holder 15 so that the electron beam B collides with the target 16, and an irradiation window 15*b* arranged in the target holder 15 and configured to extract X-rays generated from the target 15 to the outside. The inner wall of the holder shaft 14 is made of a carbon material to reduce X-rays generated when the electron beam B hits the holder shaft 14.

4 Claims, 3 Drawing Sheets

(58) Field of Classification Search
USPC ..... 378/119, 121, 138
See application file for complete search history.

(56) References Cited

FOREIGN PATENT DOCUMENTS

| | | | |
|---|---|---|---|
| JP | 56-19855 | | 2/1981 |
| JP | 2002-25484 | A | 1/2002 |
| JP | 2012-104272 | A | 5/2012 |
| JP | 2017-22054 | A | 1/2017 |

* cited by examiner

X-RAY TUBE

TECHNICAL FIELD

The present invention relates to an X-ray tube for use in an X-ray generator, and more particularly to an X-ray tube for irradiating X-rays from a micro-focus.

BACKGROUND ART

When performing nondestructive inspection of a fine internal structure of an inspection target by fluoroscopic X-rays or X-ray CT, for the purpose of obtaining a clear X-ray image with no blurring, a micro-focus X-ray inspection device using an X-ray tube having a micro-focus is used. An X-ray tube used for a micro-focus X-ray inspection device or the like realizes a small X-ray focal point by irradiating a target with an electron beam narrowed down to a μm level by a magnetic lens (see Patent Document 1).

One example of a configuration of an X-ray tube used for such a micro-focus X-ray inspection device is shown in FIG. 3. From a filament (electron source) 12 serving as a negative electrode to which a negative voltage is applied in a high-vacuum vacuum chamber 11 to which a vacuum gauge G and a turbo molecular pump TMP are attached, an electron beam B is emitted toward the grounded anode 13. At the center of the anode 13, a hole 13*a* is provided. The electron beam B is accelerated to pass through the hole 13*a* of the anode 13 and further pass through a cylindrical holder shaft 14 communicating with the hole 13*a*, and is irradiated onto the target 16 arranged in a target holder 15. The outside of the target holder 15 is cooled by a water cooling mechanism 15*a* (which may be an air cooling mechanism).

On the outside of the holder shaft 14, a magnetic lens 17 for converging the electron beam B and a deflector 18 for adjusting the direction of the electron beam B are provided. The electron beam B passing through the holder shaft 14 is narrowed down to the μm level by the magnetic lens 17 and is focused on the X-ray focal point on the target 16.

The target 16 is provided on the tip end side of the magnetic lens 17. In order to reduce the focal point to a small value, it is necessary to make the tip end portion of the magnetic lens 17 completely axially symmetrical. Since the symmetry is lost when a fixing portion, such as, e.g., a fixing hole, is provided in the magnetic lens 17, the holder shaft 14 is airtightly fixed by the O-ring seal 20 via the flange 19 on the anode 13 side.

The holder shaft 14 through which the electron beam B passes has an inner diameter of about 10 mm. This holder shaft 14 is required to be less likely to be magnetized, have heat dissipation properties, and have a high melting point since the inner wall locally reaches a high temperature when the electron beam B hits the inner wall. A tungsten alloy is used as a material meeting these requirements.

That is, tungsten is a nonmagnetic heavy metal having a melting point of 3,685 K and has sufficient resistance to a local temperature rise due to an electron beam. However, tungsten as a single metal is inferior in workability, and therefore it is used as a tungsten alloy to give ease of processing. For the target holder 15 as well, a tungsten alloy is used from the viewpoint of preventing the emission of X-rays from directions other than the X-ray irradiation window, and the target holder 15 and the holder shaft 14 are fixed by brazing.

PRIOR ART DOCUMENT

Patent Document

Patent Document 1: Japanese Unexamined Patent Application Publication No. 2002-25484

SUMMARY OF THE INVENTION

Problems to be Solved by the Invention

In the above-described X-ray tube, it is desirable to allow the electron beam B to pass through the holder shaft 14 so as not to hit the inner wall thereof, but it is actually difficult to do that. A part of the electron beam B passing through the holder shaft 14 hits the inner wall of the holder shaft 14, causing generation of X-rays.

As described above, a tungsten alloy is used for the holder shaft 14. It is known that the X-ray generation efficiency at a positive electrode when an electron beam hits the positive electrode depends on the atomic number of the positive electrode material. Since tungsten is a heavy metal, the atomic number is relatively large, and therefore even in the case of a tungsten alloy, a considerable amount of X-rays will be generated.

When an electron beam B hits and therefore X rays are generated also from the inner wall of the holder shaft 14, even if the electron beam B is converged by the magnetic lens 17, not only the X-rays radiated from the X-ray focal point on the target 16 but also a part of X-rays generated from the inner wall of the holder shaft 14 are emitted from the X-ray irradiation window. As a result, the X-ray image obtained by an X-ray inspection or the like becomes an unclear and blurred image.

Under the circumstances, the present invention aims to provide an X-ray tube capable of obtaining a clear X-ray image by reducing unnecessary X-rays radiated from a holder shaft.

Means for Solving the Problems

The X-ray tube according to the present invention made to solve the above-described problems includes: an electron source configured to generate an electron beam, an anode configured to accelerate the electron beam and having a hole allowing the electron beam B to pass through; a cylindrical holder shaft configured to form a passage which allows the electron beam B to pass through the hole of the anode; a magnetic lens arranged around the holder shaft and configured to converge the electron beam; a target holder connected to the holder shaft; a target arranged in the target holder so that the electron beam collides with the target; and an irradiation window arranged in the target holder for extracting X-rays generated from the target to an outside, wherein an inner wall of the holder shaft is made of a carbon material.

Note that for the carbon material, a material having a high melting point (sublimation point), such as, e.g., graphite, diamond, and carbon nanomaterial (e.g., carbon nanotube), can be used.

According to the present invention, the inner wall of the holder shaft is made of a carbon material. In general, the X-ray generation efficiency A is given by the following equation (1).

$$\text{Generation efficiency } (A) = C \times Z \times V \quad (1)$$

Here, C: constant ($1.1\times10^{-9}$), Z: atomic number of a positive electrode, V: tube voltage The atomic number of tungsten is 74, and the atomic number of carbon is 6. When the tube voltage is constant (for example, 100 kV), the former is 0.814% and the latter is 0.066%, and the generation efficiency changes to 1/10 or less in all tube voltages in proportion to the magnitude of the atomic number.

Therefore, by using carbon, which has an atomic number sufficiently smaller than that of tungsten, an amount of X-rays generated when an electron beam hits a holder shaft can be greatly reduced. Moreover, the melting point of carbon is comparable to the melting point of tungsten (melting point of tungsten is 3,685 K), the sublimation point in vacuum is 3,915 K or more. Thus, carbon has sufficient resistance even when it locally becomes high in temperature.

In the above-described invention, it is preferable that a carbon content rate of the carbon material be 99.9% (mass ratio) or more.

A holder shaft made of a carbon material containing impurities locally becomes a high temperature when an electron beam hits the wall surface of the holder shaft, and impurities having a low melting point sublimate in vacuum, causing a deteriorated vacuum degree. This phenomenon causes discharge in the X-ray tube, which becomes a factor of impairing the stability of the X-ray tube. Therefore, by setting the carbon content rate to 99.9% or more to thereby minimize impurities other than carbon in which the melting point and the sublimation point are low as much as possible, it becomes possible to stably irradiate X-rays.

Further, in the aforementioned invention, it is preferable that the carbon material be graphite having thermal anisotropy and a good thermal conduction direction be directed in an axial direction of the holder shaft.

With this configuration, the heat generated in the holder shaft is transmitted to the target holder to be dissipated, resulting in efficient heat dissipation.

In particular, when graphite is used, a holder shaft having thermal conductivity of 1,000 W/(m·K) or more in the good thermal conduction direction is obtained. Specifically, when a PYROID (registered trademark) of a grade HT (carbon content rate: 99.999 mass %, density: 2.22 g/cm$^3$), which is an artificial graphite manufactured by Thermo Graphic Co., Ltd., the thermal conductivity in the good thermal conduction direction becomes 1,700 W/(m·K). As a result, efficient heat dissipation can be attained.

Further, in the aforementioned invention, it may be configured such that the carbon material of the inner wall of the holder shaft is covered so that at least a part of an anode side portion of the holder shaft is covered by a cover which is nonmagnetic and has strength higher than strength of the carbon material, and is held via the cover.

The carbon material has brittle properties. Therefore, by covering at least the anode side outer wall which is a fixing portion with a nonmagnetic cover higher in strength than the carbon material of the holder shaft, the holder shaft can be fixed safely with this portion.

As a material used for the cover, specifically, titanium, or graphite (for example, high strength graphite manufactured by Toyo Tanso Co., Ltd.) higher in strength than the carbon material of the holder shaft can be used.

Effects of the Invention

According to the present invention, since the inner wall of the holder shaft that allows the electron beam to pass through is made of a carbon material, it is possible to drastically reduce the amount of X-rays generated when the electron beam hits, and maintain the thermal resistance at least equal to or higher than the conventional level.

EMBODIMENT FOR CARRYING OUT THE INVENTION

Figure 1:
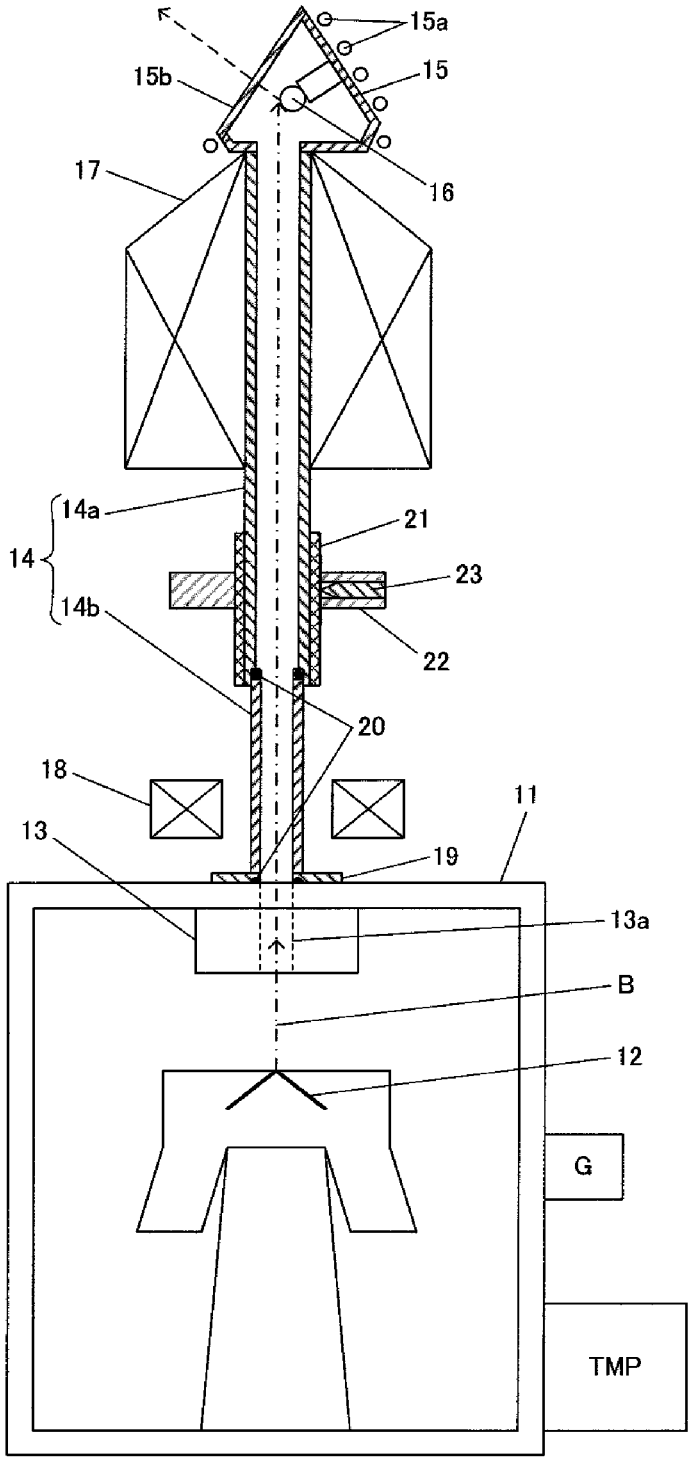
FIG. 1 is a diagram showing an overall configuration of an X-ray tube according to an embodiment of the present invention.
Figure 2:
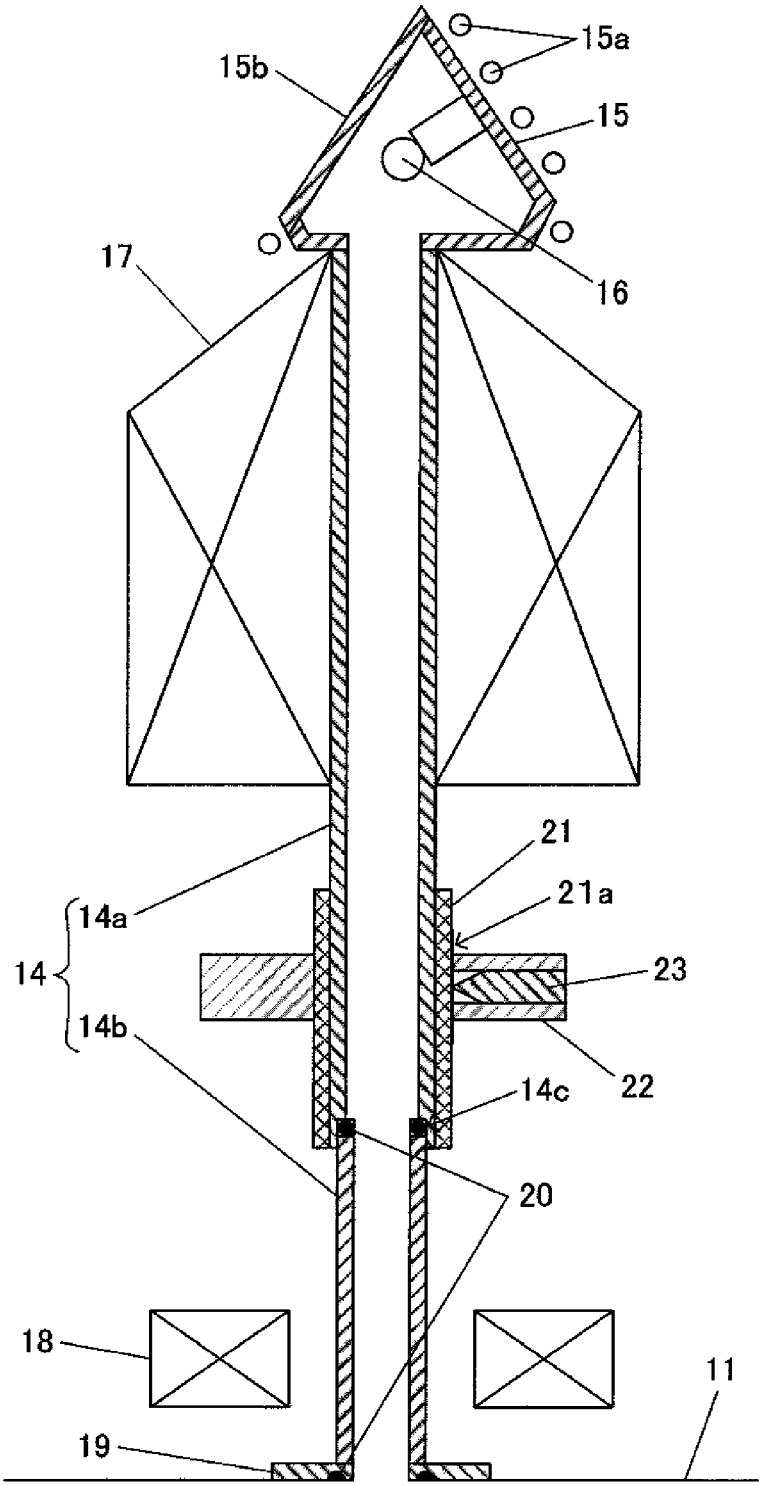
FIG. 2 is a view showing characteristic portions of the X-ray tube shown in FIG. 1.
Figure 3:
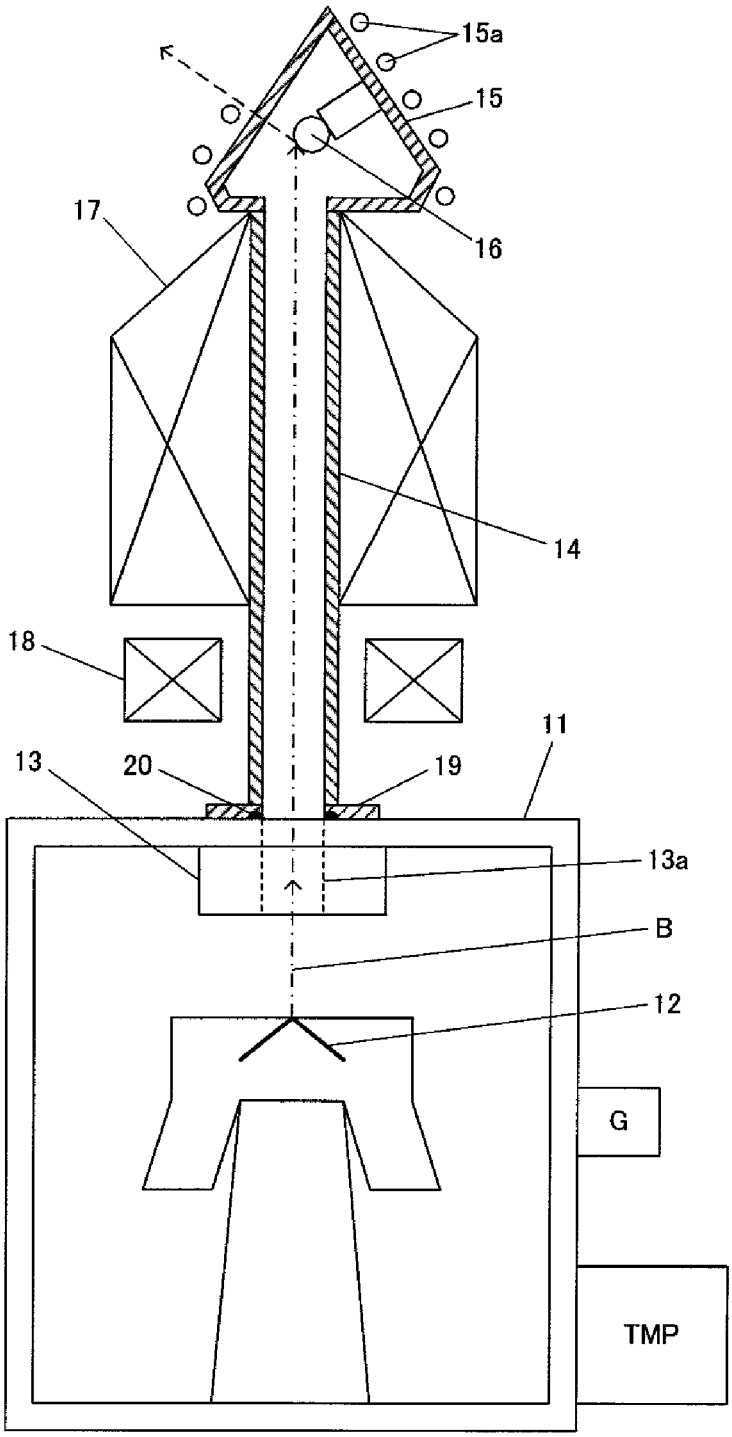
FIG. 3 is a view showing a conventional example of an X-ray tube that irradiates a micro-focus X-ray.

Hereinafter, an embodiment of an X-ray tube according to the present invention will be described with reference to the attached drawings. FIG. 1 is a diagram showing an overall configuration of an X-ray tube used in a micro-focus X-ray inspection device according to one embodiment of the present invention. FIG. 2 is an enlarged view of a characteristic structural portion including the holder shaft portion. Note that the same portion as that described with reference to FIG. 3 will be denoted by the same reference numeral.

In the X-ray tube according to the present invention, a filament (electron source) 12 serving as a negative electrode to which a negative voltage is applied is arranged in a high-vacuum vacuum chamber 11 to which a vacuum gauge G and a turbo molecular pump TMP are attached. From the filament 12, an electron beam B is emitted toward the grounded anode 13. At the center of the anode 13, a hole 13*a* is provided. The electron beam B is accelerated to pass through the hole 13*a* of the anode 13 and further pass through a cylindrical holder shaft 14 communicating with the hole 13*a*, and is irradiated onto the target 16 arranged in the target holder 15. The outside of the target holder 15 is cooled by a water cooling mechanism 15*a* (which may be an air cooling mechanism).

On the outer side of the holder shaft 14, a magnetic lens 17 for converging the electron beam B and a deflector 18 for adjusting the direction of the electron beam B are provided. The electron beam B passing through the holder shaft 14 is narrowed down to the μm level by the magnetic lens 17 and is focused on the X-ray focal point on the target 16.

In the X-ray tube according to this embodiment, the holder shaft 14 is divided into a tip end side holder shaft 14*a* (inner diameter φ: 10 mm, length: 160 mm) surrounded by the magnetic lens 17 and a basal end side holder shaft 14*b* surrounded by the deflector 18. The basal end side holder shaft 14*b* is made of a tungsten alloy in the same manner as in the holder shaft 14 of the conventional structure shown in FIG. 3, and is fixed to and supported by the vacuum chamber 11 with a flange 19 via an O-ring seal 20.

At the connecting portion of the basal end side holder shaft connecting with the tip end side holder shaft 14*a*, a stepped portion 14*c* is formed on the inner wall of the tip end side holder shaft 14*a*, and the connecting portion is connected to the stepped portion 14*c* in an airtight manner by interposing an O-ring seal 20.

For the tip end side holder shaft 14*a*, a cylindrical carbon material, preferably pure carbon, is used. Specifically, an artificial graphite of the grade HT (carbon ratio: 99.999%, density: 2.22 g/cm$^3$, thermal conductivity: 1,700 W/(m·K)) manufactured by Thermo Graphitics Co., Ltd., is used, and is processed so that the good thermal conduction direction is directed in the axial direction (longitudinal direction) of the tip end side holder shaft 14*a*.

That is, it is configured such that heat is transmitted along the good thermal conduction direction even in vacuum and heat is radiated efficiently using the water cooling mechanism 15*a* of the target holder 15.

The connection between the target holder 15 (tungsten alloy) and the tip end side holder shaft 14*a* (carbon material) is made by brazing. In cases where the carbon material is graphite, it can also be joined by a comporoid technique capable of joining with various metals, including a joint portion with the cover 21 described later.

In the vicinity of the end portion of the tip end side holder shaft 14*a* near the anode 13, a cover 21 made of a non-magnetic material, such as, e.g., titanium and having strength higher than that of the carbon material, is attached to the outside of the tip end side holder shaft 14*a*. A cut surface (D-cut surface) 21*a* is formed on a part of the outer peripheral surface of the cover 21. The shaft fixing portion 22 supported by the cover 21 and the screw 23 for fixing the shaft are brought into contact with the cut surface 21*a* so that the emission direction is directed in the direction of the X-ray irradiation window 15*b* provided in a part of the target holder 15 and the rotation does not occur at the position.

Although the cover 21 covers a part of the tip end side holder shaft 14*a*, the cover 21 may cover the entire tip end side holder shaft 14*a* including the portion surrounded by the magnetic lens 17.

As described above, at least the inner wall of the tip end side holder shaft 14*a* which is an area where the electron beam B easily hits is made of graphite which is a carbon material. Therefore, even if an electron beam hits, the X-ray generation efficiency can be suppressed to reduce generation of unnecessary X-rays.

Although one embodiment of the present invention has been described above, various modifications can be made without departing from the spirit of the present invention.

For example, in the above-described embodiment, the holder shaft is divided into the tip end side holder shaft 14*a* surrounded by the magnetic lens 17 and the basal end side holder shaft 14*b* surrounded by the deflector 18, and only the tip end side holder shaft 14*a* is made of a carbon material. However, the entire holder shaft may be formed by one holder shaft 14 which is entirely made of a carbon material. In this case, it may be configured such that a cover 21 made of a non-magnetic material is attached to the outside of the vicinity of the end portion of the holder shaft 14 on the side close to the anode 13, and fixed to the vacuum chamber 11 by a flange 19 in the same manner as in the conventional example shown in FIG. 3.

INDUSTRIAL APPLICABILITY

The present invention can be applied to an X-ray tube used for a micro-focus X-ray inspection device or the like.

DESCRIPTION OF REFERENCE SYMBOLS

11 vacuum chamber
12 filament (electron source)
13 anode
14 holder shaft
14*a* tip end side holder shaft
14*b* basal end side holder shaft
14*c* stepped portion
15 target holder
15*a* water cooling mechanism
15*b* X-ray irradiation window
16 target
17 magnetic lens
18 deflector
19 flange
20 O-ring seal
21 cover
21*a* cut surface
B electron beam

The invention claimed is:

1. An X-ray tube comprising:

an electron source configured to generate an electron beam;

an anode configured to accelerate the electron beam and having a hole allowing the electron beam B to pass through;

a cylindrical holder shaft configured to form a passage which allows the electron beam B to pass through the hole of the anode;

a magnetic lens arranged around the holder shaft and configured to converge the electron beam;

a target holder connected to the holder shaft;

a target arranged in the target holder so that the electron beam collides with the target; and an irradiation window arranged in the target holder for extracting X-rays generated from the target to an outside, wherein an inner wall of the holder shaft is made of a carbon material.

2. The X-ray device as recited in claim 1, wherein a carbon content rate of the carbon material is 99.9% or more.

3. The X-ray device as recited in claim 1, wherein the carbon material is graphite having thermal anisotropy, and wherein a good thermal conduction direction is directed in an axial direction of the holder shaft.

4. The X-ray device as recited in claim 1, wherein the carbon material of the inner wall of the holder shaft is covered so that at least a part of an anode side portion of the holder shaft is covered by a cover which is nonmagnetic and has strength higher than strength of the carbon material, and is held via the cover.

* * * * *